US008299886B2

(12) United States Patent
Won et al.

(10) Patent No.: US 8,299,886 B2
(45) Date of Patent: Oct. 30, 2012

(54) TRANSFORMER AND ELECTRONIC APPARATUS INCLUDING THE SAME

(75) Inventors: Jae Sun Won, Gyunggi-do (KR); Young Min Lee, Gyunggi-do (KR); Don Sik Kim, Gyunggi-do (KR); Dong Seong Oh, Incheon (KR); Soo Han Woo, Gyunggi-do (KR); Jin Wook Kim, Seoul (KR); Jong Hae Kim, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 22 days.

(21) Appl. No.: 12/986,653

(22) Filed: Jan. 7, 2011

(65) Prior Publication Data

US 2011/0254651 A1 Oct. 20, 2011

(30) Foreign Application Priority Data

Apr. 19, 2010 (KR) ..... 10-2010-0035837

(51) Int. Cl.
*H01F 17/04* (2006.01)

(52) U.S. Cl. ..... 336/221

(58) Field of Classification Search ..... 336/65, 336/83, 192, 196, 198, 200, 220–223
See application file for complete search history.

(56) References Cited

U.S. PATENT DOCUMENTS 4,549,130 A * 10/1985 Dobberstein ..... 323/308
5,726,616 A * 3/1998 Bell ..... 336/92
7,248,139 B1 * 7/2007 Podlisk et al. ..... 336/232
7,492,246 B2 * 2/2009 Chang ..... 336/192
7,688,171 B2 * 3/2010 Tsai et al. ..... 336/192
2012/0105186 A1 * 5/2012 Kim et al. ..... 336/61

FOREIGN PATENT DOCUMENTS

JP 2001155933 6/2001
JP 2003151834 A 5/2003

OTHER PUBLICATIONS

Korean office Action for Patent Application No. 10-2010-0035837 mailed May 14, 2011.

* cited by examiner

*Primary Examiner* — Tuyen Nguyen
(74) *Attorney, Agent, or Firm* — Lowe, Hauptman, Ham & Berner, LLP

(57) ABSTRACT

Provided are a transformer, capable of simplifying a manufacturing process and enhancing heat dissipation characteristics and insulating characteristics by adopting a dual-bobbin structure and configuring a secondary winding as a metallic plate extending to the outside, and an electronic device including the same. Heat dissipation from a primary winding is facilitated by forming a primary winding at the outer side. Furthermore, a secondary metallic plate, although formed inside, includes extension portions to thereby facilitate heat dissipation from the secondary metallic plate. Also, by adopting a dual bobbin structure for outer and inner bobbins, a sufficient distance for insulation between the primary winding and the secondary metallic plate is ensured to thereby enhance an insulating function. Further, a manufacturing process can be simplified by forming a secondary winding as a metallic plate manufactured in advance.

19 Claims, 6 Drawing Sheets

TRANSFORMER AND ELECTRONIC APPARATUS INCLUDING THE SAME

CROSS-REFERENCE TO RELATED APPLICATIONS

This application claims the priority of Korean Patent Application No. 10-2010-35837 filed on Apr. 19, 2010, in the Korean Intellectual Property Office, the disclosure of which is incorporated herein by reference.

BACKGROUND OF THE INVENTION

1. Field of the Invention

The present invention relates to a transformer and an electronic apparatus including the same, and more particularly, to a transformer, capable of simplifying a manufacturing process and enhancing heat dissipation characteristics and insulating characteristics by adopting a dual-bobbin structure and configuring a secondary winding as a metallic plate extending to the outside, and an electronic device including the same.

2. Description of the Related Art

In general, an electronic device requires driving power to be driven, and therefore indispensably employs a power supply for supplying power to the electronic device.

The power supply switches commercial power to rectified DC power, and converts the switched DC power into power having a voltage level appropriate for driving power according to a turns ratio. For this voltage-level conversion, the power supply uses a transformer.

The transformer includes a single bobbin and forms a turns ratio for the voltage-level conversion by coupling a core through a through hole of the bobbin and then winding a primary winding and a secondary winding, which are coils, around a winding region of the bobbin.

After the primary winding is wound around the winding region of the bobbin, the secondary winding is wound thereon in a stacked manner. In this case, it is not easy to dissipate heat generated from the primary winding and to ensure sufficient distance to insulate the primary winding from the secondary winding. Furthermore, since the primary and secondary windings are formed by winding coils, the manufacturing process is complicated.

SUMMARY OF THE INVENTION

An aspect of the present invention provides a transformer capable of simplifying a manufacturing process and enhancing heat dissipation characteristics and insulating characteristics by using a dual bobbin structure and configuring a secondary winding as a metallic plate extending to the outside, and an electronic device including the same.

According to an aspect of the present invention, there is provided a transformer including: a bobbin part including an outer bobbin including a first bobbin body having a predetermined length, a first through hole formed in a longitudinal direction of the first bobbin body and a first winding region formed around an outer circumferential surface of the first bobbin body, and an inner bobbin including a second bobbin body having a predetermined length, a second through hole formed in a longitudinal direction of the second bobbin body and a second winding region formed around an outer circumferential surface of the second bobbin body, the inner bobbin being inserted into the first through hole of the outer bobbin; a core part including a first core and a second core, wherein portions of the first and second cores are electromagnetically coupled to each other through the second through hole of the inner bobbin; and a winding portion including a primary winding wound around the first winding region of the outer bobbin, and at least one secondary metallic plate wound around the second winding region of the inner bobbin, the at least one secondary metallic plate having at least one extension portion extending to the outside.

The outer bobbin may include a first support portion provided on a lower portion of the first bobbin body and supporting the first bobbin body, the inner bobbin may include a second support portion provided on a lower portion of the second bobbin body and supporting the second bobbin body, and when the inner bobbin is inserted into the first through hole of the outer bobbin, the first support portion and the second support portion may be spaced apart from each other at a predetermined distance to thereby form a separation space between the first support portion and the second support portion.

The extension portion of the at least one secondary metallic plate may extend to the outside through the separation space.

The at least one secondary metallic plate may be wound around the second winding region of the inner bobbin and have at least one turn.

The secondary metallic plate may include a first secondary metallic plate and a second secondary metallic plate. The first secondary metallic plate may be wound around the second winding region of the inner bobbin and has at least one turn, and the second secondary metallic plate may be stacked on the first secondary metallic plate and wound to have at least one turn.

The first secondary metallic plate may include an extension portion extending to the outside through the separation space, and the second secondary metallic plate may include an extension portion extending to the outside through the separation space.

The outer bobbin may include a protrusion portion formed on an upper portion of the first bobbin body, and the inner bobbin may include a recess portion formed in an upper portion of the second bobbin body and coupled with the protrusion portion of the outer bobbin.

The at least one secondary metallic plate may include a support portion bent from the extension portion and supporting the at least one secondary metallic plate, wherein the support portion may have a fixing hole.

The first and second secondary metallic plates may include support portions bent from the extension portions and supporting the first and second secondary metallic plates, respectively, wherein the support portions may have fixing holes.

According to another aspect of the present invention, there is provided an electronic device including: a board having a mounting region; a transformer including a bobbin part including an outer bobbin including a first bobbin body having a predetermined length, a first through hole formed in a longitudinal direction of the first bobbin body and a first winding region formed around an outer circumferential surface of the first bobbin body, and an inner bobbin including a second bobbin body having a predetermined length, a second through hole formed in a longitudinal direction of the second bobbin body and a second winding region formed around an outer circumferential surface of the second bobbin body, the inner bobbin being inserted into the first through hole of the outer bobbin, a core part including a first core and a second core, wherein portions of the first and second cores are electromagnetically coupled to each other through the second through hole of the inner bobbin, and a winding portion including a primary winding wound around the first winding region of the outer bobbin, and at least one secondary metallic plate wound around the second winding region of the inner bobbin, the at least one secondary metallic plate having at least one extension portion extending to the outside; and a heat dissipation body formed on the board, connected to the extension portion of the at least one secondary metallic plate, and dissipating heat generated from the at least one secondary metallic plate.

The electronic device may further include a rectifier formed on the mounting region of the board, rectifying power from the transformer and outputting the rectified power.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

Figure 1:
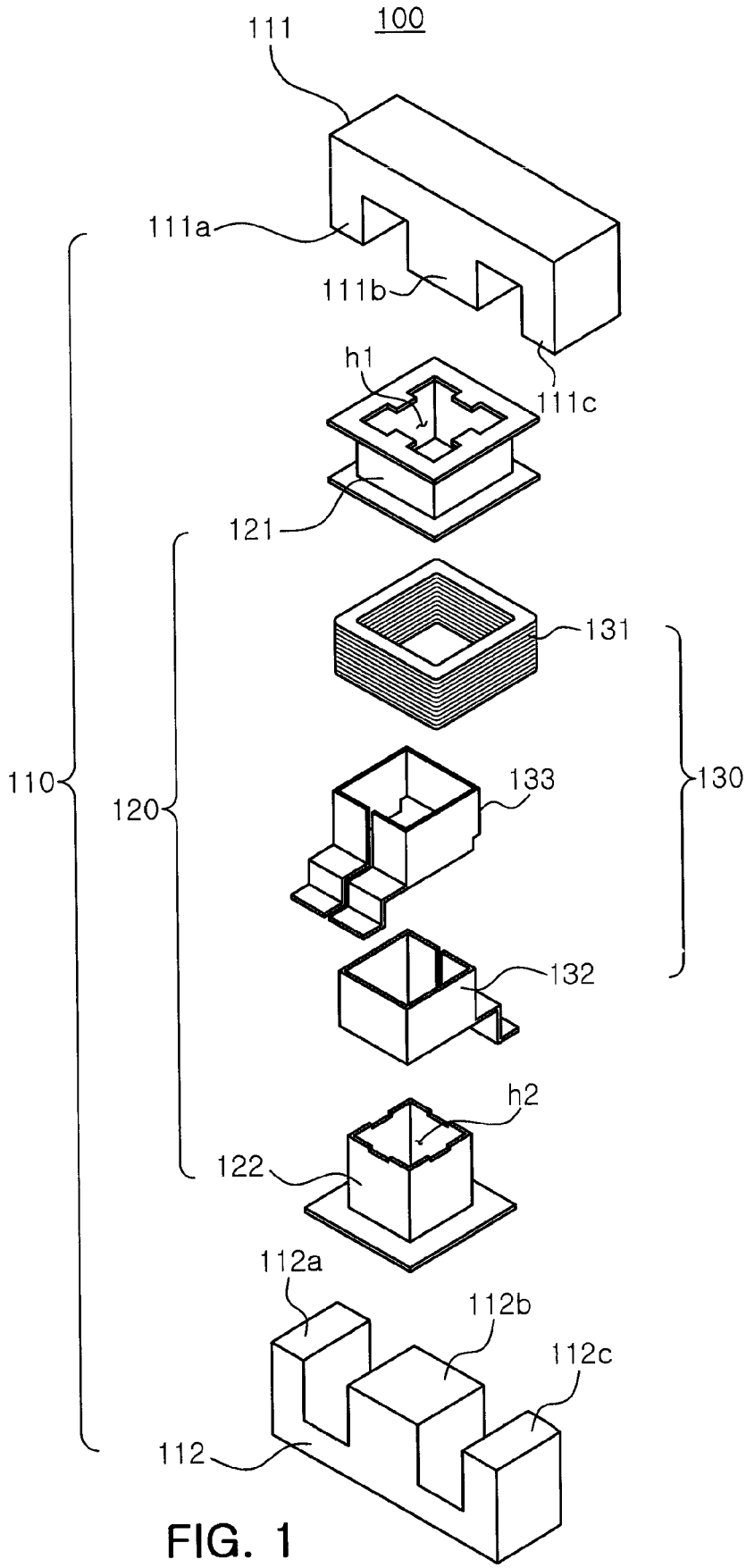
FIG. 1 is an exploded perspective view illustrating a transformer according to an exemplary embodiment of the present invention.
Figure 2A:
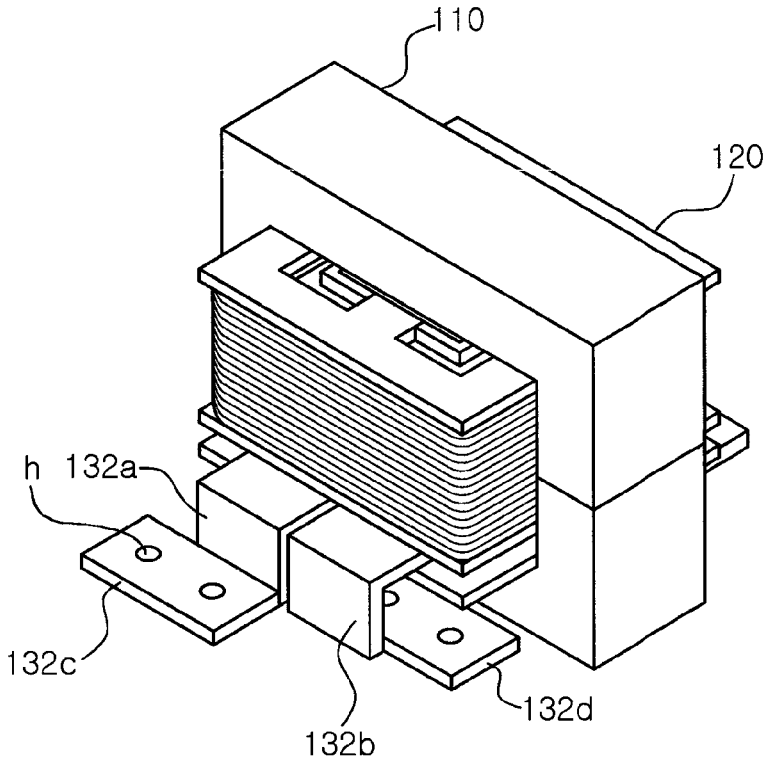
FIGS. 2A and 2B are schematic perspective views illustrating an assembled transformer according to an exemplary embodiment of the present invention.
Figure 2B:
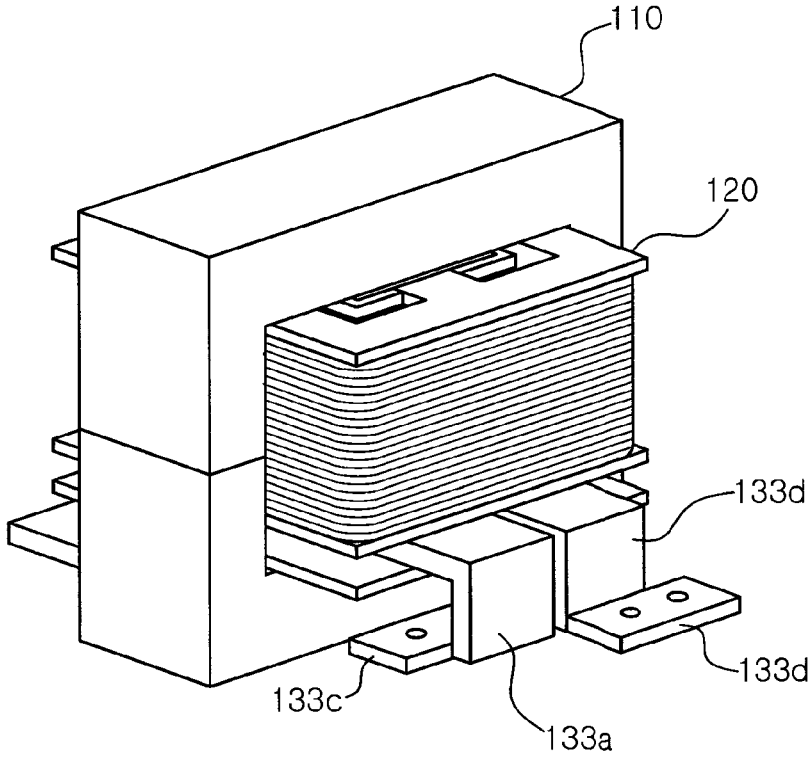

FIG. 1 is a schematic exploded perspective view illustrating a transformer according to an exemplary embodiment of the present invention. FIGS. 2A and 2B are schematic perspective views illustrating an assembled transformer according to an exemplary embodiment of the present invention.

Referring to FIGS. 2A and 2B along with FIG. 1, a transformer 100, according to this exemplary embodiment, may include a core part 110, a bobbin part 120 and a winding part 130.

The core part 110 may include a first core 111 and a second core 112, a pair of cores that are electromagnetically coupled to each other.

The pair of cores 111 and 112 may include legs that are electromagnetically coupled with each other.

The pair of first and second cores 111 and 112 may be EE cores as illustrated, or may be configured variously as EI cores, UU cores, UI cores or the like.

As illustrated above, the first core 111 includes first to third legs 111*a*, 111*b* and 111*c*, and the second core 112 also includes first to third legs 112*a*, 112*b* and 112*c*. The pair of first and second cores 111 and 112 may be electromagnetically coupled to each other by the coupling between the first legs 111*a* and 112*a*, the second legs 111*b* and 112*b* and the third legs 111*c* and 112*c*.

The bobbin part 120 may be provided between the pair of first and second cores 111 and 112.

The bobbin part 120 may include an outer bobbin 121 and an inner bobbin 122.

The outer bobbin 121 may include a first bobbin body having a predetermined length, and a first through hole h1 extending in a longitudinal direction of the first bobbin body. A winding region may be formed around the outer circumferential surface of the first bobbin body. Here, a coil is wound around the winding region.

The inner bobbin 122 may include a second bobbin body having a predetermined length, and a second through hole h2 extending in a longitudinal direction of the second bobbin body. A winding region may be formed around the outer circumferential surface of the second bobbin body.

The inner bobbin 122 may be inserted through the first through hole h1 of the outer bobbin 121, and the pair of first and second cores 111 and 112 may be electromagnetically coupled to each other through the second through hole h2 of the inner bobbin 122. That is, when the pair of first and second cores 111 and 112 are EE cores, the second leg 111*b* of the first core 111 and the second leg 112*b* of the second core 112 may be electromagnetically coupled to each other through the second through hole h2 of the inner bobbin 122.

The bobbin part 130 may include a primary winding 131 configured as a core having a preset number of turns, and one or more secondary metallic plates 132 and 133.

The primary winding 131 may be configured as a coil having a preset number of turns and be wound around the winding region of the outer bobbin 121. The primary winding 131 receives switched power and directs power to one or more secondary metallic plates 132 and 133.

The one or more secondary metallic plates 132 and 133 form a preset turns ratio with the primary winding 131 and therefore convert a voltage level of power input to the primary winding 131 and output the converted power. The one or more secondary metallic plates 132 and 133 may be wound around the winding region of the inner bobbin 122.

The one or more secondary metallic plates 132 and 133 may include a first secondary metallic plate 132. The first secondary metallic plate 132 may be wound around the winding region of the inner bobbin 122 so as to have a single turn. Furthermore, the one or more secondary metallic plates 132 and 133 may include a second secondary metallic plate 133, and the second secondary metallic plate 133 may be wound so as to have a single turn. The second secondary metallic plate 133 may be wound by being stacked on the first secondary metallic plate 132. Although not shown, an insulator for electric insulation may be formed between the second secondary metallic plate 133 and the first secondary metallic plate 132.

As the primary winding 131 is formed on an outer portion as compared to the secondary metallic plates 132 and 133, the dissipation of heat generated from the primary winding 131 can be facilitated. However, heat may be generated by current flowing through the secondary metallic plates 132 and 133. Therefore, the first secondary metallic plate 132 may include extension portions 132*a* and 132*b*, and the second secondary metallic plate 133 may include extension portion 133*a* and 133*b*.

The extension portions 132*a* 132*b*, 133*a* and 133*b* of the first and second secondary metallic plates 132 and 133 may extend to the outside through a separation space between the outer bobbin 121 and the inner bobbin 122. The extension portions 132*a*, 132*b*, 133*a* and 133*b* may be connected to a separate heat dissipation body provided outside in order to dissipate heat from the first and second secondary metallic plates 132 and 133.

To this end, the first secondary metallic plate 132 may include support portions 132*c* and 132*d* extending from the extension portions 132*a* and 132*b*, and the second secondary metallic plate 133 may include support portions 133*c* and 133*d* extending from the extension portions 133*a* and 133*b*. Here, the support portions 132*c*, 132*d*, 133*c* and 133*d* are connected to the heat dissipation body and support the first and second secondary metallic plates 132 and 133. The support portions 132*c*, 132*d*, 133*c* and 133*d* may have various shapes. For example, the support portions 132*c*, 132*d*, 133*c* and 133*d* may be bent toward the transformer 100 or in an opposite direction to the transformer 100. Furthermore, each of the support portions 132*c*, 132*d*, 133*c* and 133*d* may have a fixing hole h so as to be fixed to the heat dissipation body.

Hereinafter, the configuration of a bobbin part employed in the transformer according to an exemplary embodiment of the present invention will be described.

FIGS. 3A through 3E are schematic views illustrating the configuration of a bobbin part employed in a transformer according to an exemplary embodiment of the present invention.

Referring to FIGS. 3A through 3E along with FIG. 1 and FIGS. 2A and 2B, the bobbin part 120 employed in the transformer 100 according to this exemplary embodiment, includes the outer bobbin 121 and the inner bobbin 122. The outer bobbin 121 may have a first support portion 121*a* supporting the first bobbin body, and the inner bobbin 122 may have a second support portion 122*a* supporting the second bobbin body. When the inner bobbin 122 is inserted into the first through hole h1 of the outer bobbin 121, the first support portion 121*a* and the second support portion 122*a* are spaced apart from each other at a predetermined distance to thereby form a separation space a therebetween. The extension portions 132*a*, 132*b*, 133*a* and 133*b* of the first and second secondary metallic plates 132 and 133 may extend to the outside through the separation space a.

For the coupling between the outer bobbin 121 and the inner bobbin 122 and the maintenance of the separation space a, a protrusion portion 121*b* may be formed on the upper portion of the first bobbin body, while a recess portion 122*b* may be formed in the upper portion of the second bobbin body. Accordingly, the protrusion portion 121*b* of the outer bobbin 121 is coupled to the recess portion 122*b* of the inner bobbin 122 to thereby couple the outer bobbin 121 to the inner bobbin 122 and maintain the separation space a.

Figure 3A:
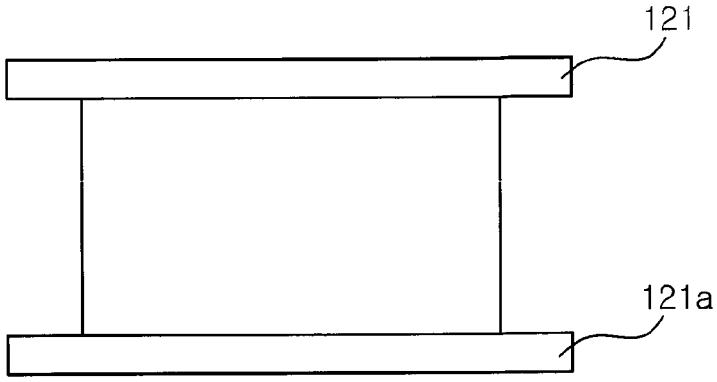
FIGS. 3A through 3E are schematic views illustrating the configuration of a bobbin part employed in a transformer according to an exemplary embodiment of the present invention.
Figure 3B:
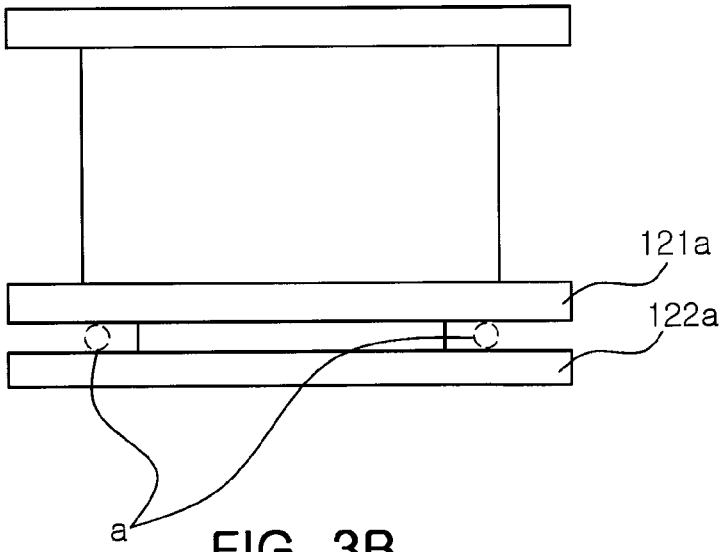
Figure 3C:
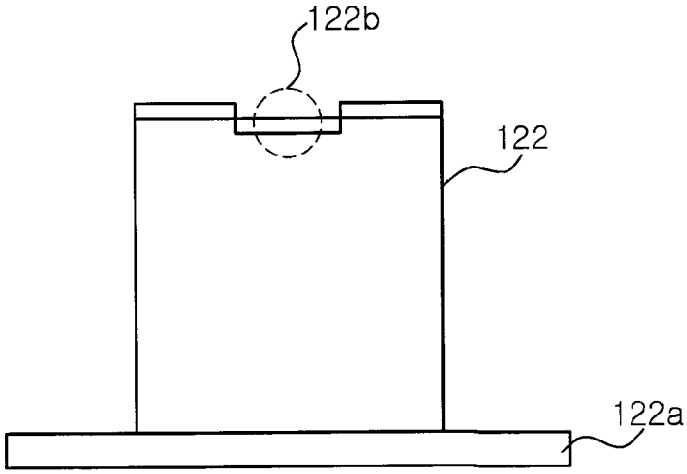
Figure 3D:
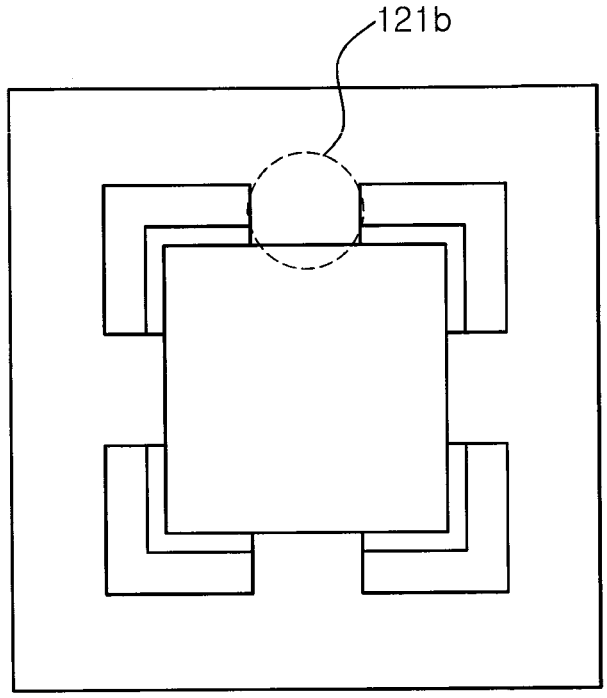
Figure 3E:
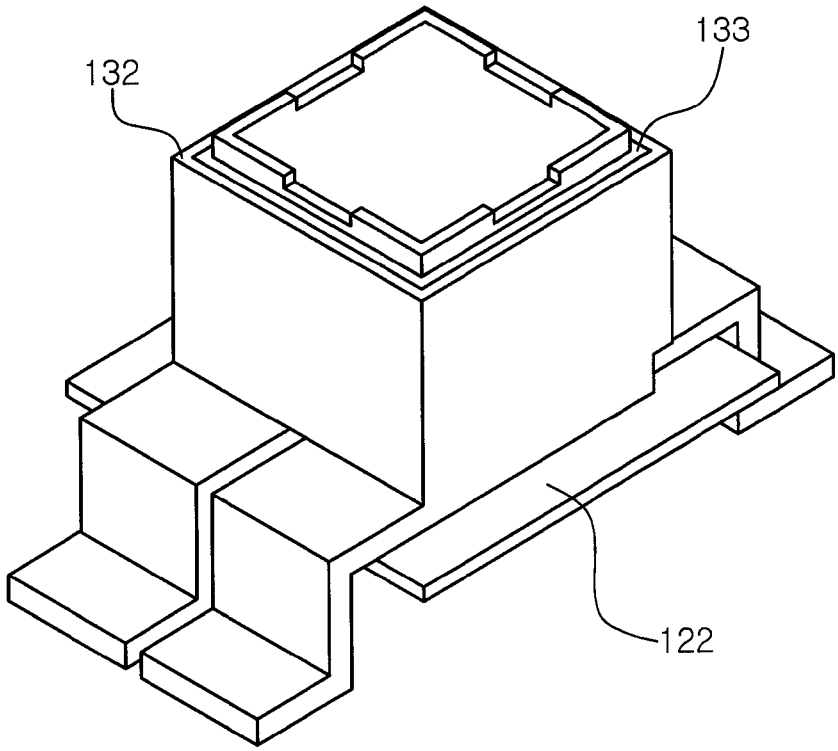

Furthermore, as shown in FIG. 3E, the first secondary metallic plate 132 has its start and end portions opposing each other in such a manner as to form a through hole therein. Thus, the inner bobbin 122 is inserted into the through hole of the first secondary metallic plate 132. The second secondary metallic plate 133 also has its start and end portions opposing each other in such a manner as to form a through hole therein. Thus, the inner bobbin 122 and the first secondary metallic plate 132 may be inserted into the through hole of the second secondary metallic plate 133. Furthermore, the extension portions 132*a* and 132*b* may extend from the start and end portions of the first secondary metallic plate 132, and the extension portions 133*a* and 133*b* may extend from the start and end portions of the second secondary metallic plate 133.

Figure 4A:
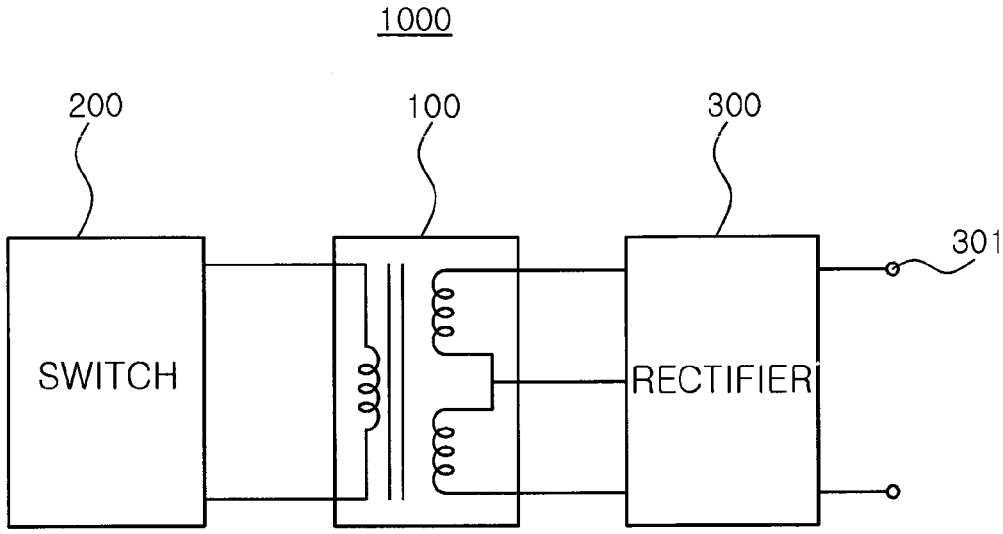
FIG. 4A through 4C are schematic views illustrating an electronic device employing a transformer according to an exemplary embodiment of the present invention.
Figure 4B:
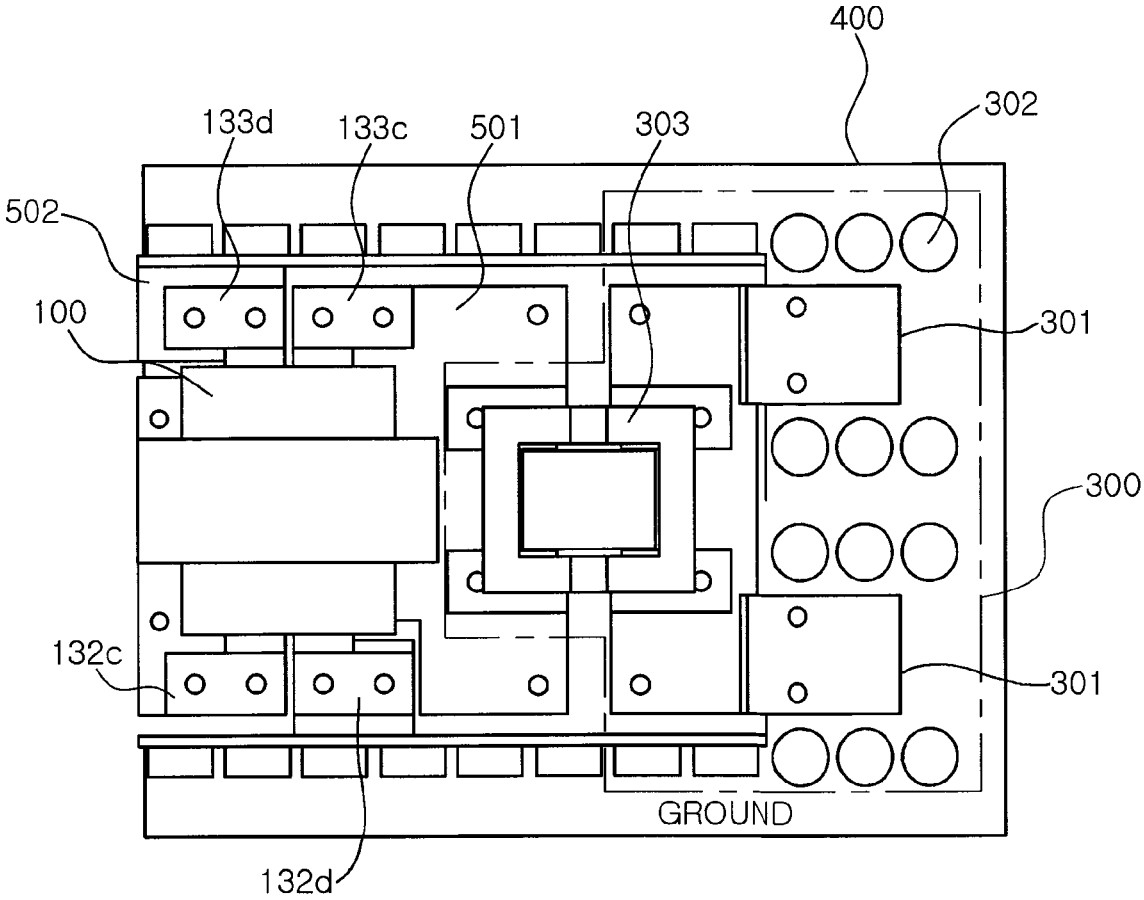
Figure 4C:
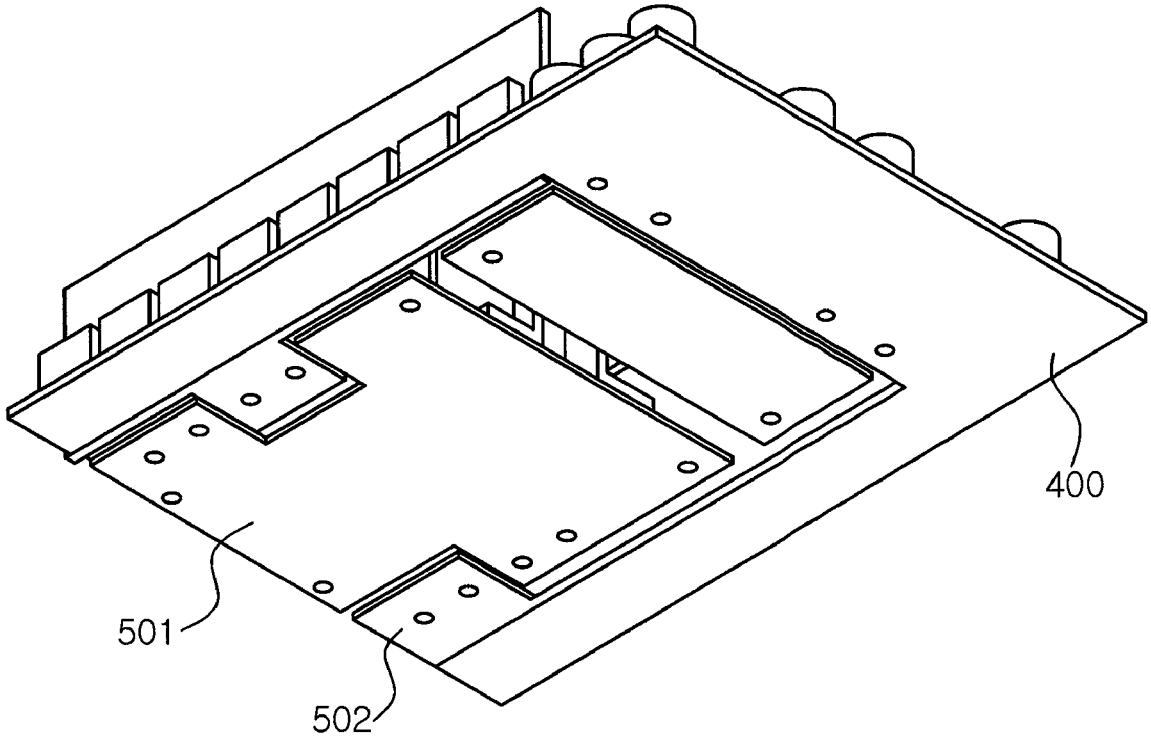

FIGS. 4A through 4C are schematic views illustrating the configuration of an electronic device employing the transformer according to an exemplary embodiment of the present invention.

Referring to FIGS. 4A through 4C, an electronic device 1000 may convert a voltage level of power, switched by a switch 200, by using the transformer 100, rectify the converted power by using a rectifier 300, and then output the rectified power through an output port 301.

This electronic device 1000 may be formed by mounting the transformer 100 and the rectifier 300 on a mounting region on a board 400. Heat dissipation bodies 501 and 502 may be formed in the mounting region in order to dissipate heat generated from the secondary metallic plates. The transformer 100 may be supported on the heat dissipation bodies 501 and 502 by the fixing holes h of the support portions 132*c*, 132*d*, 133*c* and 133*d*.

An output port 301, a capacitor 302 and an inductor 303 of the rectifier 300 may be formed on the mounting region of the board 400.

As described above, according to the present invention, heat dissipation from a primary winding is facilitated by forming the primary winding at the outer edge. Furthermore, a secondary metallic plate, although formed inside, includes the extension portions to thereby facilitate heat dissipation from the secondary metallic plate. Also, by adopting a dual bobbin structure of outer and inner bobbins, a sufficient distance to insulate the primary winding from the secondary metallic plate is ensured to thereby enhance an insulating function. Further, the manufacturing process can be simplified by forming a secondary winding as a metallic plate manufactured in advance.

As set forth above, according to exemplary embodiments of the invention, a dual-bobbin structure is adopted, and a secondary winding is configured as a metallic plate extending to the outside, to thereby simplify a manufacturing process and enhance heat dissipation characteristics and insulating characteristics.

While the present invention has been shown and described in connection with the exemplary embodiments, it will be apparent to those skilled in the art that modifications and variations can be made without departing from the spirit and scope of the invention as defined by the appended claims.

What is claimed is:

1. A transformer comprising:

a bobbin part comprising an outer bobbin including a first bobbin body having a predetermined length, a first through hole formed in a longitudinal direction of the first bobbin body and a first winding region formed around an outer circumferential surface of the first bobbin body, and an inner bobbin including a second bobbin body having a predetermined length, a second through hole formed in a longitudinal direction of the second bobbin body and a second winding region formed around an outer circumferential surface of the second bobbin body, the inner bobbin being inserted into the first through hole of the outer bobbin;

a core part comprising a first core and a second core, wherein portions of the first and second cores are electromagnetically coupled to each other through the second through hole of the inner bobbin; and a winding portion comprising a primary winding wound around the first winding region of the outer bobbin, and at least one secondary metallic plate wound around the second winding region of the inner bobbin, the at least one secondary metallic plate having at least one extension portion extending to the outside.

2. The transformer of claim 1, wherein the outer bobbin comprises a first support portion provided on a lower portion of the first bobbin body and supporting the first bobbin body, the inner bobbin comprises a second support portion provided on a lower portion of the second bobbin body and supporting the second bobbin body, and when the inner bobbin is inserted into the first through hole of the outer bobbin, the first support portion and the second support portion are spaced apart from each other at a predetermined distance to thereby form a separation space between the first support portion and the second support portion.

3. The transformer of claim 2, wherein the extension portion of the at least one secondary metallic plate extends to the outside through the separation space.

4. The transformer of claim 1, wherein the at least one secondary metallic plate is wound around the second winding region of the inner bobbin and has at least one turn.

5. The transformer of claim 2, wherein the secondary metallic plate comprises a first secondary metallic plate and a second secondary metallic plate, wherein the first secondary metallic plate is wound around the second winding region of the inner bobbin and has at least one turn, and the second secondary metallic plate is stacked on the first secondary metallic plate and is wound to have at least one turn.

6. The transformer of claim 5, wherein the first secondary metallic plate comprises an extension portion extending to the outside through the separation space, and the second secondary metallic plate comprises an extension portion extending to the outside through the separation space.

7. The transformer of claim 1, wherein the outer bobbin comprises a protrusion portion formed on an upper portion of the first bobbin body, and the inner bobbin comprises a recess portion formed in an upper portion of the second bobbin body and coupled with the protrusion portion of the outer bobbin.

8. The transformer of claim 3, wherein the at least one secondary metallic plate comprises a support portion bent from the extension portion and supporting the at least one secondary metallic plate, wherein the support portion has a fixing hole.

9. The transformer of claim 6, wherein the first and second secondary metallic plates comprise support portions bent from the extension portions and supporting the first and second secondary metallic plates, respectively, wherein the support portions have fixing holes.

10. An electronic device comprising:

a board having a mounting region;

a transformer comprising:

a bobbin part comprising an outer bobbin including a first bobbin body having a predetermined length, a first through hole formed in a longitudinal direction of the first bobbin body and a first winding region formed around an outer circumferential surface of the first bobbin body, and an inner bobbin including a second bobbin body having a predetermined length, a second through hole formed in a longitudinal direction of the second bobbin body and a second winding region formed around an outer circumferential surface of the second bobbin body, the inner bobbin being inserted into the first through hole of the outer bobbin;

a core part comprising a first core and a second core, wherein portions of the first and second cores are electromagnetically coupled to each other through the second through hole of the inner bobbin; and a winding portion comprising a primary winding wound around the first winding region of the outer bobbin, and at least one secondary metallic plates wound around the second winding region of the inner bobbin, the at least one secondary metallic plate having at least one extension portion extending to the outside; and a heat dissipation body formed on the board, connected to the extension portion of the at least one secondary metallic plate, and dissipating heat generated from the at least one secondary metallic plate.

11. The electronic device of claim 10, wherein the outer bobbin comprises a first support portion provided on a lower portion of the first bobbin body and supporting the first bobbin body, the inner bobbin comprises a second support portion provided on a lower portion of the second bobbin body and supporting the second bobbin body, and when the inner bobbin is inserted into the first through hole of the outer bobbin, the first support portion and the second support portion are spaced apart from each other at a predetermined distance to thereby form a separation space between the first support portion and the second support portion.

12. The electronic device of claim 11, wherein the extension portion of the at least one secondary metallic plate extends to the outside through the separation space.

13. The electronic device of claim 10, wherein the at least one secondary metallic plate is wound around the second winding region of the inner bobbin and has at least one turn.

14. The electronic device of claim 11, wherein the secondary metallic plate comprises a first secondary metallic plate and a second secondary metallic plate, wherein the first secondary metallic plate is wound around the second winding region of the inner bobbin and has at least one turn, and the second secondary metallic plate is stacked on the first secondary metallic plate and is wound to have at least one turn.

15. The electronic device of claim 14, wherein the first secondary metallic plate comprises an extension portion extending to the outside through the separation space, and the second secondary metallic plate comprises an extension portion extending to the outside through the separation space.

16. The electronic device of claim 10, wherein the outer bobbin comprises a protrusion portion formed on an upper portion of the first bobbin body, and the inner bobbin comprises a recess portion formed in an upper portion of the second bobbin body and coupled with the protrusion portion of the outer bobbin.

17. The electronic device of claim 12, wherein the at least one secondary metallic plate comprises a support portion bent from the extension portion and supporting the at least one secondary metallic plate, wherein the support portion has a fixing hole fixed to the heat dissipation body.

18. The electronic device of claim 15, wherein the first and second secondary metallic plates comprise support portions bent from the extension portions and supporting the first and second secondary metallic plates, respectively, wherein the support portions have fixing holes fixed to the heat dissipation body.

19. The electronic device of claim 10, further comprising a rectifier formed on the mounting region of the board, rectifying power from the transformer and outputting the rectified power.

* * * * *